United States Patent [19]

Poole

[11] Patent Number: 4,626,406

[45] Date of Patent: Dec. 2, 1986

[54] ACTIVATED SINTERING OF METALLIC POWDERS

[75] Inventor: Jon M. Poole, Huntington, W. Va.

[73] Assignee: Inco Alloys International, Inc., Huntington, W. Va.

[21] Appl. No.: 792,033

[22] Filed: Oct. 28, 1985

[51] Int. Cl.[4] ..... C22C 32/00

[52] U.S. Cl. ..... 419/12; 419/10; 419/23; 419/36; 419/37; 419/40; 419/41; 419/43; 419/65; 419/66; 419/67; 419/69

[58] Field of Search ..... 419/12, 10, 23, 36, 419/37, 40, 41, 43, 65, 66, 67, 69

[56] References Cited

U.S. PATENT DOCUMENTS

| | | | |
|---|---|---|---|
| 4,011,291 | 3/1977 | Curry | 419/37 |
| 4,259,112 | 3/1981 | Dolowy et al. | 419/40 |
| 4,298,383 | 11/1981 | Joyce | 419/36 |
| 4,546,047 | 10/1985 | Ryan | 419/40 |
| 4,554,130 | 11/1985 | Ecer | 419/36 |
| 4,562,040 | 12/1985 | Yamada et al. | 419/40 |

*Primary Examiner*—Stephen J. Lechert, Jr.

*Attorney, Agent, or Firm*—Edward A. Steen; Raymond J. Kenny

[57] ABSTRACT

A method for consolidating powder utilizing slurry extrusion or rolling techniques. A metallic powder, binder and boron containing activator are mixed together to form a slurry. The slurry is introduced into an active forming apparatus whereupon it is formed into an object of predetermined shape and sintered.

20 Claims, 3 Drawing Figures

ACTIVATED SINTERING OF METALLIC POWDERS

TECHNICAL FIELD

The instant invention relates to consolidation of metallic powders in general and, more particularly, to a process for the pressureless consolidation of metallic powders.

BACKGROUND ART

There are various schemes for consolidating metallic powders. Among the more common methods are hot isostatic pressing ("HIP"), hydrostatic pressing, explosive forming, slip casting, can extrusion and injection molding. Each technique has its advantages and disadvantages. The disadvantages generally include complex and expensive equipment and limited final configurations.

The instant invention, however, is concerned with powder metallurgy ("PM") slurry techniques such as extrusion and rolling. The equipment is essentially conventional, widely available and does not call for exceedingly great care to operate successfully.

In brief, metallic powder is mixed with a water soluble binder, lubricant, and water to form a thick slurry. The slurry is then introduced into an extrusion press, rolling mill, or injection molding die to produce a desired shape. The resulting product is dried and sintered. Key benefits of this processing route are improved yield and resultant cost savings.

Unfortunately, the resulting product may have poor density and, therefore, unacceptable working characteristics. In order to improve the formability properties, the density of the object in most cases must be high. Although low density is not always associated with low formability, given identical powder characteristics, increased density will result in improved formability.

Another benefit of high density is that the piece can tolerate a more severe forming operation. At very low density levels (70–80% dense), the material can only be consolidated by complete compressive operations such as HIP. At higher density levels (80–90%), the piece can be cold formed (or hot formed under atmosphere) by partially compressive operations such as the reducing or rolling. With 90% density or better, the piece can be hot worked in air as the porosity is not interconnected and internal oxidation is not a problem. At 95% density or better, the piece can tolerate some tensile operations such as hot rolling or drawing. At 99% dense or better, the piece can be treated as a wrought material. To summarize, density increases can be associated with improved formability and an increasing diversity of available forming operations.

Moreover, the orientation of the voids within the product is paramount. Spherical voids are to be avoided since they tend to lower the strength of the product. Rather, irregular voids are desirable inasmuch as they boost the strength of the object.

Other researchers have noted the effect of boron containing additions on powder alloys. Firstly, U.S. Pat. No. 3,704,508 outlines the CAP (consolidated at atomospheric pressure) process. Here, metallic powders are mixed with a boric acid-methanol solution, sealed and sintered to a fully dense piece. Secondly, U.S. Pat. No. 4,407,775 reveals a method to consolidate metallic powders by the addition of lithium tetraborate. The process utilized in this reference is identical to that of the CAP process. Thirdly, U.S. Pat. No. 4,113,480 discloses a method for injection molding of powders where a boric acid-glycerin mix is used to promote mold release and densification. Lastly, U.S. Pat. No. 4,197,118 relates to a method of binder removal before sintering.

SUMMARY OF THE INVENTION

The instant invention relates to a method of cold slurry extrusion and rolling wherein the density and the working characteristics of the product are improved. To accomplish this end, metallic powder is mixed with a water soluble binder, water and a boron containing activator, formed to shape, heat treated, and sintered. The boron containing activator can be nickel boride (NiB) or a finely divided metal borate (i.e., $Li_2B_4O_7$) or a dilute boric acid-water solution. The instant method is applicable to superalloys and highly ferrous and nonferrous powders.

PREFERRED MODE FOR CARRYING OUT THE INVENTION

Figure 1:
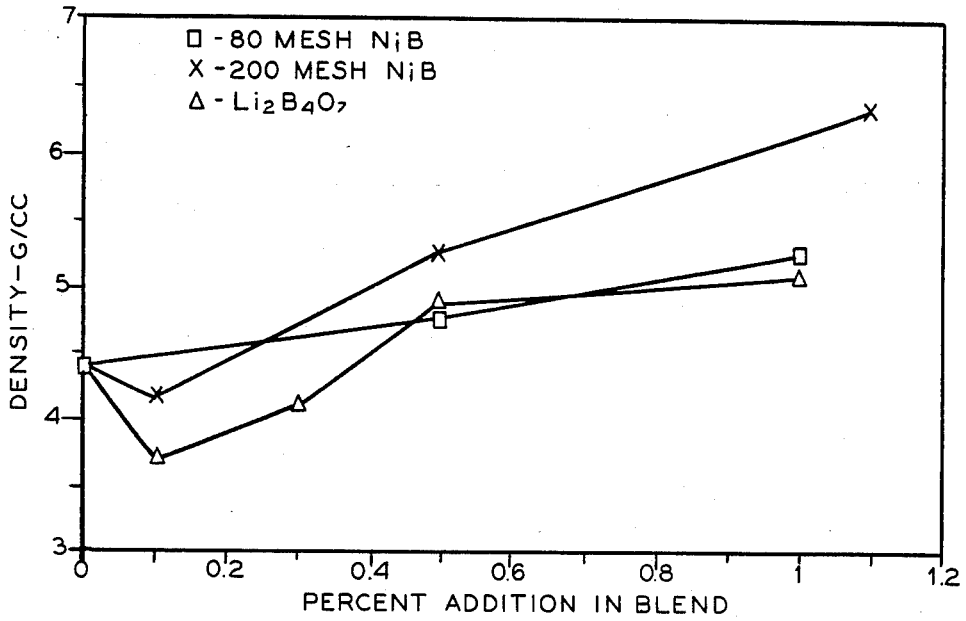
FIG. 1 is a graph depicting density and weight percent addition in the powder blend.

It has been determined that the addition of a boron containing compound or a water-boric acid mixture as an activator to a metallic powder/binder slurry greatly improves the characteristics of products formed by the pressureless consolidation of powder.

The instant invention produces a finished product by the P/M slurry technique. The technique involves the mixing of metallic powders with a binder and activator to form a plastic mixture or slurry which is extruded or rolled, heat treated and sintered. Key benefits of this processing route are improved yield and resultant cost savings.

Components of the powder slurry usually include the alloy powder, binder (1–4 wt %), lubricants (0–1 wt %), modifiers (0–1 wt %) and water (5–20 wt %). Lubricants may be added to reduce the extrusion force, and modifiers (i.e., glycerin) may be added as a plasticizer. The water soluble binder is used to "glue" the powder together until the powder is sintered. During heating and sintering the binder is removed as a gas or liquid while the alloy powder binds together. Hopefully, the sintering operation, which is generally greater than 85% of the alloy's melting point, will densify the material such that it has sufficient ductility so it can be successfully formed. Unfortunately, this does not always occur and it is desirable to add a boron containing activator to enhance the densification (and formability) of the powder during sintering of the product.

In the first experiment, four identical, pickled, water atomized INCOLOY ® alloy 825 slurry blends (blends 1,2,3,4) were made except that blends 1 and 2 were mixed with a water-5% boric acid solution wherein blends 3 and 4 were mixed solely with distilled water. (INCOLOY is a trademark of the INCO family of companies.)

INCOLOY alloy 825 is a nickel base alloy especially useful in aggressively corrosive environments. Its nominal composition includes (by weight) about 38–46% nickel, 19.5–23.5% chromium, 2.5–3.5% molybdenum, 0.6–1.2% titanium, 1.5–3.0% copper, balance iron and other elements. Water atomized INCOLOY alloy 825 powders are commercially available. Pickling of these powders was performed in a 20% nitric acid-2% hydrofluoric acid solution to remove the oxide film on the powders as a result of the atomization process. For future reference the pickled, water atomized INCOLOY alloy 825 powder is designated by powder lot 1.

The composition of these first four initial blends were:

TABLE I

| BLEND | INCOLOY ALLOY 825 POWDER LOT 1 (Grams) | INCO NICKEL 123 POWDER (Grams) | BINDER* (Grams) | WATER (Grams) | BORIC ACID IN SOLUTION (%) |
|---|---|---|---|---|---|
| 1 | 112.0 | 50.0 | 6.0 | 32.0 | 5.0 |
| 2 | 112.0 | 50.0 | 6.0 | 28.0 | 5.0 |
| 3 | 112.0 | 50.0 | 6.0 | 32.0 | 0.0 |
| 4 | 112.0 | 50.0 | 6.0 | 32.0 | 0.0 |

*NATROSOL, a trademark of Hercules Incorporated, is a water soluble hydroxyethyl cellulose polymer.

In the above table, the INCO ®Nickel Powder type 123 was added due to a lack of available INCOLOY alloy 825 powder and did not influence the subsequent comparative results. INCO Nickel Powder type 123 is an essentially pure, commercially available nickel powder having an irregular shape, and a 3–7 micron particle size. (INCO is a trademark of the INCO family of companies.)

The water-boric acid solution was prepared by dissolving crystalline boric acid in warm (120° F. or 49° C.) distilled water. The slurries were prepared by mixing the dry ingredients in a lab mixer to a homogeneous mixture, then incrementally adding the distilled water or boric acid solution until the slurry had a clay-like consistency.

Each resulting slurry, was placed into an extrusion press whereupon it was formed into a rod of about 0.35 inch (0.89 cm) diameter. The rod was allowed to air dry for approximately 48 hours before being heated to about 900° F. (482° C.) under nitrogen atmosphere for about one hour for binder burnout. The rod was then sintered at either 2200° F. (1316° C.) for about four hours under either a hydrogen or argon protective cover in order to prevent oxidation.

Density after sintering was estimated by measuring the volume and weight of the piece. This procedure produces results comparable to the accepted ASTM immersion method. The averaged density results are as follows:

TABLE 2

| BLENDS | SINTERING TEMPERATURE (°F.) FOR 4 HOURS UNDER ATMOSPHERE M.C. 2400 H (1316° C.) | 2400 Ar (1316° C.) | 2200 Ar (1204° C.) |
|---|---|---|---|
| 1 and 2 | 5.89 g/cc | 7.42 g/cc | 5.89 g/cc |
| 3 and 4 | 5.42 g/cc | 6.64 g/cc | 4.41 g/cc |

NOTE:
M.C. = "muffle cool" When the object is removed from the heating zone, the object remains in the protective environment until cooled to room temperature.

It was clear from the above trials that the additions of a relatively dilute (5%) boric acid-water mixture added to a water soluble binder resulted in a near net shape of desirably high density while simultaneously eliminating the need for complex and expensive HIP equipment. It was also apparent that the argon protective cover yielded improved results and this is believed to be due to the removal of the boron by the hydrogen atmosphere.

After successful findings to the above exploratory results, additional concerted experiments were devised to determine the effectiveness of the boron containing activators under various conditions.

The second experiment was exploratory work with various additions. Here the benefits of boron containing additions were reinforced. This first study of solid, finely-divided activator additions was performed on pickled, water atomized INCOLOY alloy 825 powder (lot 1) using NiS, NiB (−80 mesh), NiB (−200 mesh), lithium tetraborate ($Li_2B_4O_7$), magnesium stereate ($C_{17}H_{35}COOMg$), and zinc stereate ($C_{17}H_{35}COOZn$) as activators.

Selected blends in this experiment were formulated as follows:

TABLE 3

| BLEND | INCOLOY ALLOY 825 POWDER LOT 1 (Grams) | INCO NICKEL 123 POWDER (Grams) | BINDER* (Grams) | WATER (Grams) | ACTIVATOR (Grams) |
|---|---|---|---|---|---|
| 5 | 112.0 | 50.0 | 6.0 | 32.0 | 0.0 |
| 6 | 111.0 | 50.0 | 6.0 | 32.0 | 1.0 NiB |
| 7 | 110.0 | 50.0 | 6.0 | 32.0 | 2.0 NiB |
| 8 | 111.0 | 50.0 | 6.0 | 32.0 | 1.0 $Li_2B_4O_7$ |
| 9 | 110.0 | 50.0 | 6.0 | 32.0 | 2.0 $Li_2B_4O_7$ |
| 10 | 111.8 | 50.0 | 6.0 | 32.0 | 0.2 NiB |
| 11 | 111.0 | 50.0 | 6.0 | 32.0 | 1.0 NiB |
| 12 | 110.0 | 50.0 | 6.0 | 32.0 | 2.2 NiB |
| 13 | 111.8 | 50.0 | 6.0 | 32.0 | 0.2 $Li_2b_4O_7$ |
| 14 | 111.4 | 50.0 | 6.0 | 32.0 | 0.6 $Li_2B_4O_7$ |

*NATROSOL

In the above table, the INCO Nickel Powder type 123 was added due to a lack of available pickled, water atomized, INCOLOY alloy 825 (lot 1) powder, and did not influence the subsequent comparative results. Blends 6 and 7 had a −80 mesh size (less than 200 microns) NiB addition and blends 10, 11 and 12 had a −200 mesh size (less than 75 microns) NiB addition. Other blends prepared with the assorted other activator additions are omitted because the subsequent results proved to have no beneficial effect.

The slurries were prepared by mixing the dry ingredients in a lab mixer to a homogeneous mixture, then the distilled water was incrementally added until the slurry had a clay-like consistency.

Figure 2:
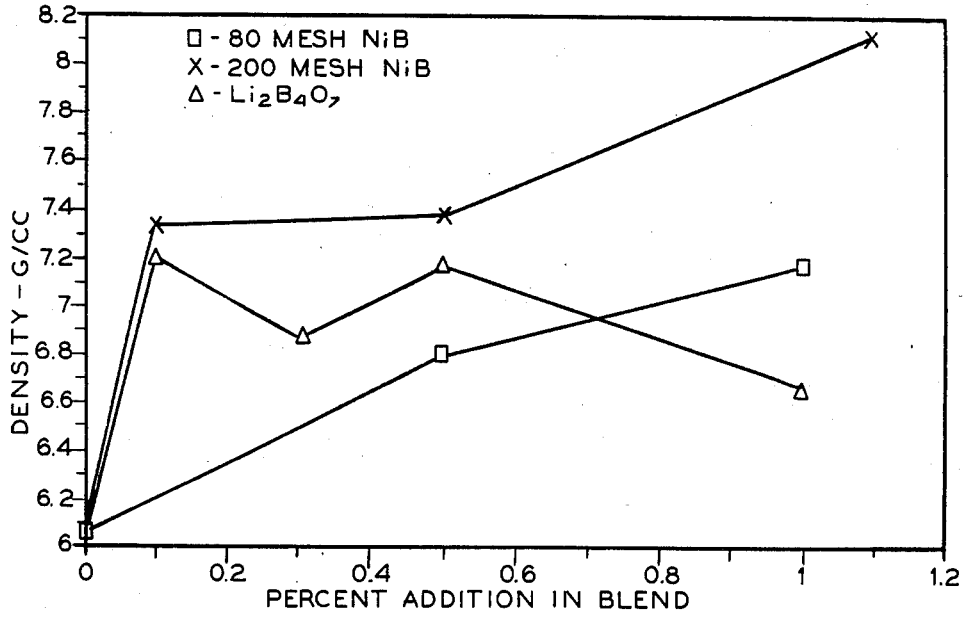
FIG. 2 is a graph depicting density and weight percent addition in the powder blend.

Each resulting slurry was placed into an extrusion press whereupon it was formed into a rod of about 0.35 inch (9.89 cm) diameter. The rod was allowed to air dry for appromixately 48 hours before being heated to about 900° F. (482° C.) under nitrogen for about one half hour for binder burnout. The rod was then sintered at either 2200° F. (1204° C.) or 2400° F. (1316° C.) for about 4 hours under an argon protective cover in order to prevent oxidation. Results are shown in FIG. 1 and FIG. 2 respectively.

It is clear that additions of NiB or $Li_2B_4O_7$ (lithium tetraborate) increased the density of the product with the −200 mesh size NiB showing the best results followed by the $Li_2B_4O_7$. The NiB with the −80 mesh size was unsatisfactory due to localized metlting and nonuniform density in the piece. Thus it was shown the 0–1% of a boron containing addition increases the density of pickled, water atomized INCOLOY alloy 825 powder (lot 1).

The first two experiments clearly illustrated the beneficial effect of boron containing activators on water atomized INCOLOY alloy 825 powder (lot 1). In a third experiment, it was shown that boron containing activators have a positive effect on gas atomized INCOLOY alloy 825 powder (lot 2).

The composition of the blends for this third experiment are:

TABLE 4

| BLEND | INCOLOY ALLOY 825 POWDER (LOT 2) (Grams) | BINDER* (Grams) | WATER (Grams) | BORIC ACID IN SOLUTION (%) | ACTIVATOR (Grams) |
|---|---|---|---|---|---|
| 15 | 180.0 | 6.0 | 15.0 | 0.0 | 0.0 |
| 16 | 180.0 | 6.0 | 15.0 | 0.5 | 0.0 |
| 17 | 180.0 | 6.0 | 15.0 | 1.0 | 0.0 |
| 18 | 172.0 | 6.0 | 20.0 | 0.0 | 2.0 NiB |

*NATROSOL

Figure 3:
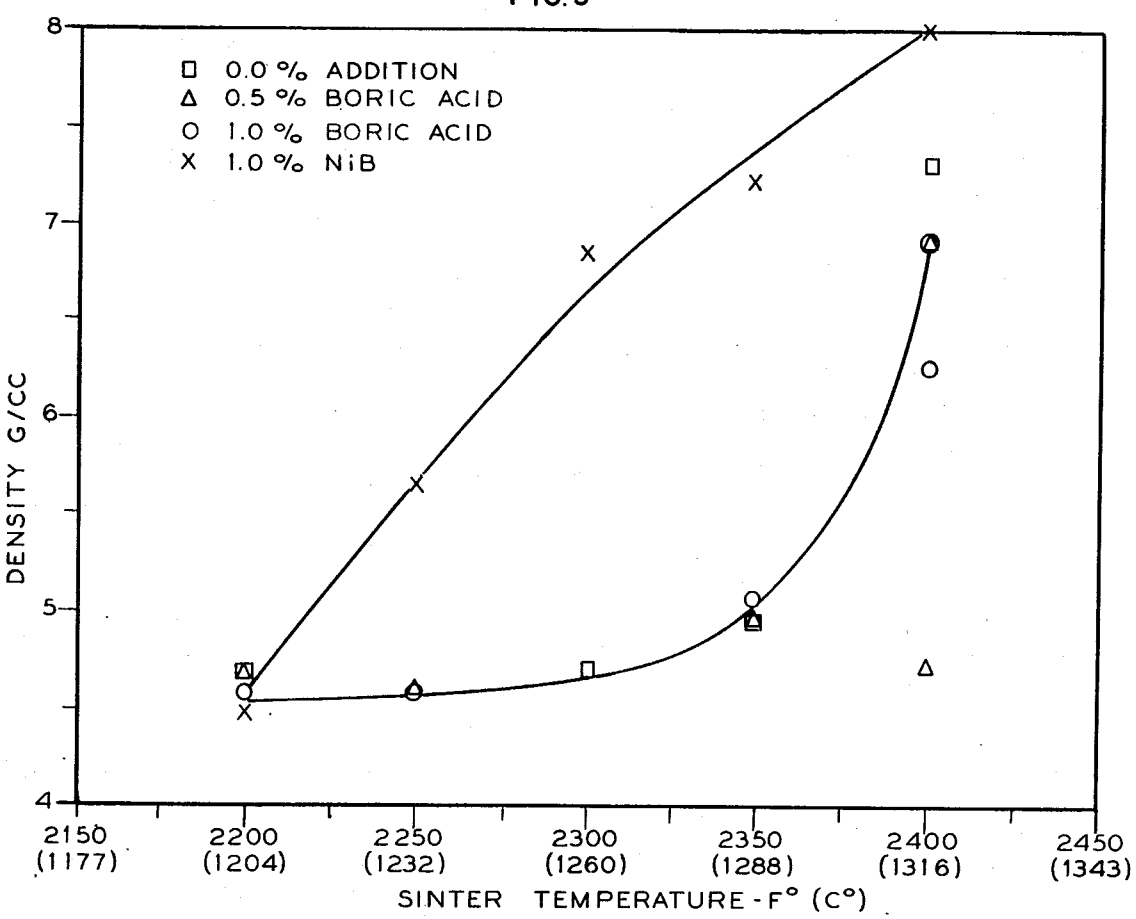
FIG. 3 is a graph depicting density and sintering temperature in the powder blend.

The slurries were prepared using the procedure described in experiments 1 and 2. Each slurry was placed into an extrusion press whereupon it was formed into a rod of about 0.35 inch (0.89 cm) diameter. The rod was allowed to air dry for about 48 hours. Binder burnout was accomplished by heating to 900° F. (482° C.) under nitrogen and holding for one-half hours. Sintering took place between 2200° F. (1204° C.) to 2400° F. (1316° C.) for about four hours under either a dry hydrogen or argon atmosphere. FIG. 3 depicts density and sintering temperature results for this experiment.

It was apparent that the addition of NiB enhanced the sintering process over the entire sintering range. Rather unexpectedly, the boric acid addition had no effect on the density results. The reason for this is unclear, but is probably related to the characteristics of the gas atomized INCOLOY alloy 825 (lot 2) powder.

The fourth experiment investigated the effect of a boric acid addition to a modified gas atomized powder alloy. This alloy is a low nickel version of INCOLOY alloy 825 (about 26.1% nickel 26.7% chromium, 38.8% iron, 4.02% molybdenum plus others). INCO Nickel Powder type 123 was blended with the powder to yield a powder with an INCOLOY alloy 825 composition (lot 3). It has been postulated that by doping the powder with additional nickel, the resultant diffusion gradient would enhance the sintering. In this instance no benefit of the nickel addition was observed.

Several blends were prepared as follows:

TABLE 5

| BLEND | INCOLOY ALLOY 825 POWDER LOT 3 (Grams) | BINDER* (Grams) | WATER (Grams) | BORIC ACID IN SOLUTION (%) |
|---|---|---|---|---|
| 19 | 180.0 | 6.0 | 15.0 | 0.0 |
| 20 | 180.0 | 6.0 | 15.0 | 0.5 |
| 21 | 180.0 | 6.0 | 15.0 | 1.0 |
| 22 | 180.0 | 6.0 | 15.0 | 3.0 |
| 23 | 180.0 | 6.0 | 15.0 | 5.0 |

*NATROSOL

The slurries were prepared using the procedure described in experiments 1 and 2. Each slurry was placed into an extrusion press whereupon it was formed into a rod of about 0.35 inch (0.89 cm) diameter. The rod was allowed to air dry for about 48 hours. Binder burnout was accomplished by heating to 900° F. (482° C.) under nitrogen and holding for one-half hour. Sintering took either at 2200° F. (1204° C.) or 2400° F. (1316° C.) for about four hours under either a dry hydrogen or argon atmosphere.

The results of this experiment indicated that the boric acid addition had no effect on the pieces sintered at 2200° F. (1204° C.). At 2400° F. (1316° C.) a slight positive density increase was noted with the 0.5% boric acid addition when sintered in hydrogen. With the argon protective cover a larger density increase was observed with 0.5% and 1.0% boric acid levels. Pieces produced with the 3% and 5% boric acid levels presented an unusual problem. After air drying the boric acid crystallized to form a white solid in the piece. This caused some localized melting and an undesirable uneven density. Hence, boric acid levels about about 3% (by weight in solution) should be avoided. This is not believed to be critical as there is no benefit in using boric acid concentrations exceeding about 3% in solution.

Experiment 5 briefly examined the effect of pickling. The gas atomized powder used in experiment 4 was pickled in a 20% nitric-2% hydrofluoric acid. After this operation, the methodology in experiment 4 was duplicated. No effect of the pickling operation was observed.

Results of this experiment show that there is little or no effect of the boric acid addition when the pieces are sintered at 2200° F. (1204° C.). At 2400° F. (1316° C.) there may be some benefit by using the boric acid addition but the results are inconclusive.

In the last experiment (experiment 6), the effect of a glycerin-boric acid addition was investigated. Glycerin acts as a plasticizer for the water soluble binders and it was postulated that it would improve the homogeneity of the extruded and air dried piece.

Several blends were prepared with the following compositions:

TABLE 6

| BLENDS | INCOLOY ALLOY 825 POWDER LOT 3 (Grams) | BINDER* (Grams) | WATER (Grams) | BORIC ACID IN SOLUTION (%) | GLYCERIN (ml) |
|---|---|---|---|---|---|
| 24 | 180.0 | 6.0 | 13.0 | 0.0 | 2.0 |
| 25 | 180.0 | 6.0 | 14.0 | 0.5 | 1.0 |
| 26 | 180.0 | 6.0 | 13.0 | 0.5 | 2.0 |
| 27 | 180.0 | 6.0 | 9.0 | 0.5 | 6.0 |
| 28 | 180.0 | 6.0 | 13.0 | 1.0 | 2.0 |

*NATROSOL

The slurries were prepared using the procedure described in experiments 1 and 2. Each slurry was placed into an extrusion press whereupon it was formed into a rod of about 0.35 inch (0.89 cm) diameter. The rod was allowed to air dry for about 48 hours. Binder burnout was accomplished by heating to 900° F. (482° C.) under nitrogen and holding for one-half hour. Sintering took either at 2200° F. (1204° C.) or 2400° F. (1316° C.) for about four hours under either a dry hydrogen or argon atmosphere.

It was observed that there is no benefit in using the glycerin-boric acid additions in the pieces sintered at 2200° F. (1204° C.). At 2400° F. (1316° C.), although the data was minimal, there was some indication that a 0.5% boric acid-0.5% glycerin addition to the pieces might improve the density by a very small margin.

The slurry may be placed in an extrusion device (as above) or it may be rolled to form the desired shape. Extrusion and rolling techniques will generally result in bar, rod, sheet or tube.

The term "active forming means" as utilized in the specification is defined to distinguish the instant method from the injection molding techniques and essentially passive molding techniques as taught in the aforementioned U.S. patents.

It should be appreciated, however, that the choices of binder and metallic powder are not limited to the identified materials above. Rather, any comparable binder and selected powder may be used.

Regardless of the materials selected, the resulting product is sufficiently dense to improve its working characteristics. Boron containing compounds or a dilute boric acid-water solution boost the density of the extrusion.

In conclusion, additions of boron containing activators will increase the density of nickel containing PM slurry extrusions. Additions of up to about 1.2% $Li_2B_4O_7$, 1.2% NiB (−200 mesh preferred) and in some cases boric acid (up to 5%, remainder water) may be used effectively. As the sintering temperature is raised, from 2200° F. (1204° C.) to about 2400° F. (1316° C.), the densities are increased as well.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows:

1. A method for consolidating a product from metallic powder, the method comprising:

(a) blending the powder with a binder and a boron containing activator to form a slurry, (b) introducing the slurry into an active forming apparatus to cause the formation of an object of predetermined shape, (c) removing the binder from the object, and (d) sintering the object.

2. The method according to claim 1 wherein the activator is selected from the group consisting of dilute boric acid-water solution, nickel boride and lithium tetraborate.

3. The method according to claim 2 wherein the nickel boride is −80 mesh and smaller.

4. The method according to claim 1 wherein the slurry is extruded.

5. The method according to claim 1 where the slurry is cold rolled.

6. The method according to claim 1 wherein the sintering temperature is 85% of the melting point of the alloy or greater.

7. The method according to claim 1 wherein the density of the object is in excess of 5 grams per cubic centimeter.

8. The method according to claim 2 wherein up to about 5% boric acid-water solution is used as the activator for water atomized powder.

9. The method according to claim 2 wherein up to about a 1% boric acid-water solution is used as the activator for gas atomized powder.

10. The method according to claim 2 wherein up to about a 1% boric acid-water solution is used as the activator for water atomized powder.

11. The method according to claim 1 wherein the activator content ranges up to about 1.2% by weight of the powder.

12. The method according to claim 1 wherein additional nickel powder is added to the metallic powder prior to the formation of the slurry.

13. The method according to claim 1 wherein the powder is atomized.

14. The method according claim 1 wherein the metal powder includes nickel.

15. The method according to claim 1 wherein the activator is a metal borate.

16. The method according to claim 1 wherein the density of the object is 90% or greater.

17. The method according to claim 1 where the binder content ranges from about 1 to 4% by weight of the powder.

18. The method according the claim 1 where the binder is water soluble.

19. The method according to claim 1 where water is added to form the slurry.

20. The method according to claim 19 wherein the water content ranges from about 5 to 20% by weight of the powder.

* * * * *